US008730641B2

(12) United States Patent
Fukada

(10) Patent No.: US 8,730,641 B2
(45) Date of Patent: May 20, 2014

(54) STATIC ELECTRICITY REMOVING APPARATUS AND METHOD THEREOF

(75) Inventor: Yoshinari Fukada, Koganei (JP)

(73) Assignee: Koganei Corporation (JP)

( * ) Notice: Subject to any disclaimer, the term of this patent is extended or adjusted under 35 U.S.C. 154(b) by 81 days.

(21) Appl. No.: 13/366,832

(22) Filed: Feb. 6, 2012

(65) Prior Publication Data

US 2012/0212874 A1 Aug. 23, 2012

(30) Foreign Application Priority Data

Feb. 18, 2011 (JP) ..... 2011-033907

(51) Int. Cl.
*H05F 3/00* (2006.01)
*H05F 3/04* (2006.01)
*H01T 23/00* (2006.01)

(52) U.S. Cl.
USPC ..... 361/213; 361/230

(58) Field of Classification Search
USPC ..... 361/212, 213, 230
See application file for complete search history.

(56) References Cited

U.S. PATENT DOCUMENTS 8,032,040 B2 * 10/2011 Lee ..... 399/45
2007/0097591 A1 * 5/2007 Fujiwara et al. ..... 361/220
2008/0232021 A1 * 9/2008 Gefter et al. ..... 361/213

FOREIGN PATENT DOCUMENTS

JP 52-030440 A 3/1977
JP 04-206378 A 7/1992
JP 2006-196380 A 7/2006
JP 2007-287368 A 11/2007

* cited by examiner

*Primary Examiner* — Rexford Barnie
*Assistant Examiner* — Christopher Clark
(74) *Attorney, Agent, or Firm* — Cantor Colburn LLP

(57) ABSTRACT

A static electricity removing apparatus for removing static electricity of a charged object comprises a discharge electrode which generates an ionized air having a polarity opposite to that of the object by discharge, an auxiliary electrode which is provided with openings for the ionized air generated by the discharge electrode to pass through, and an electric field forming means which forms an electric field in a space between the auxiliary electrode and the object. The electric field forming means generates the electric field between the auxiliary electrode and the object by allowing a potential having a polarity opposite to that of the object to occur in the auxiliary electrode at the start of the static electricity removal and decreases the electric field between the auxiliary electrode and the object when an absolute value of the potential of the object is equal to or less than a predetermined value.

6 Claims, 6 Drawing Sheets

STATIC ELECTRICITY REMOVING APPARATUS AND METHOD THEREOF

CROSS-REFERENCE TO RELATED APPLICATION

The present application is related to, claims priority from, and incorporates by reference Japanese Patent Application No. 2011-033907 filed on Feb. 18, 2011.

BACKGROUND OF THE INVENTION

1. Field of the Invention

The present invention relates to a static electricity removing apparatus and method thereof for neutralizing an object charged with static electricity by means of ionized air generated by corona discharge.

2. Description of Related Art

In manufacturing and assembling an electronic part such as a semiconductor substrate, if the electronic part or a tool for handling the electronic part is charged with static electricity, the electronic part is likely to suffer from adhesion of contaminants such as dusts and a circuit in the electric part is possibly broken by discharging. In order to prevent such problems, a static electricity removing apparatus called an ionizer has been used for neutralizing an object, or removing static electricity of the object, by spraying ionized air on the object charged with static electricity (see JP 2007-287368 A, JP 2006-196380 A, JP 52-30440 A, and JP04-206378 A).

DC or AC corona discharge is generally used for generating ionized air. Ionized air generated by corona discharge may be sprayed on an object by using compressed air or a fan in general.

Static electricity removing apparatuses using AC corona discharge are disclosed in JP 52-30440 A and JP 04-206378 A.

These documents disclose techniques for controlling disparity in balance of ions generated by AC corona discharge and preventing an object to be neutralized from being incompletely neutralized and being charged negatively or positively. For example, FIG. 4 of JP 52-30440 A discloses a configuration in which a grid electrode having a grid shape is installed between an AC corona discharge electrode and the object to be neutralized on a plate electrode grounded. The grid electrode is grounded through a diode and a resistor. In addition, JP 04-206378 A discloses a structure which controls to vary a resistance value between a ground electrode opposite to the discharge electrode and a ground potential, according to a charge potential of a charged object.

SUMMARY OF THE INVENTION

In a DC corona discharge type static electricity removing apparatus, the adjustment of an amount of transported ions is generally performed by a voltage applied on a discharge electrode. In other words, as the voltage applied to the discharge electrode is increased, the amount of transported ions is increased. Herein, the term "DC type" means, not only the case where a constant positive or negative voltage is applied on as a power supply voltage, but also the case where a DC bias is applied on an AC voltage to shift it to a positive side or a negative side so that one type of ion such as positive type ions or negative type ions are dominant.

Herein, it is assumed that, for example, the object is positively charged. In this case, a negative voltage is applied to the discharge electrode. At the start of the neutralization, the potential difference between the object positively charged and the discharge electrode applied with a negative voltage is high, so that a large amount of ions may be transported to the object. However, if the object is neutralized to some degree so that the potential thereof is lowered, an electric field around the object is lowered, and the force of transporting the ions to the object becomes small. If the force of transporting the ions is small, the time taken for the neutralization is elongated.

It is an object of the present invention to provide a static electricity removing apparatus and a static electricity removing method capable of reducing the time taken for neutralization.

According to a first aspect of the present invention, there is provided a static electricity removing apparatus for removing static electricity of a charged object, comprising: a discharge electrode which generates an ionized air having a polarity opposite to that of the object; an auxiliary electrode which is provided with openings for the ionized air to pass through; and an electric field forming means which forms an electric field in a space between the auxiliary electrode and the object, in which the electric field forming means generates the electric field by applying a potential having a polarity opposite to that of the object to the auxiliary electrode at the start of the static electricity removal, and decreases the electric field by making the potential of the auxiliary electrode lower than that at the start of the static electricity removal when an absolute value of the potential of the object is equal to or less than a predetermined value.

The electric field forming means may include a resistance value changing means which changes a resistance value between the auxiliary electrode and the ground potential to change the potential of the auxiliary electrode. The resistance value changing means may include: a resistor; and a switch which connects the auxiliary electrode to a ground electrode through the resistor at the start of the static electricity removal and connects the auxiliary electrode to a ground potential without the resistor at the end of the static electricity removal.

An electrode of which at least a portion is formed in a net shape may be used as the auxiliary electrode.

The static electricity removing apparatus may further comprise a potential sensor which measures the potential of the object, in which the time when the potential of the object becomes a predetermined value may be detected by the potential sensor. In addition, in the case where a time-changing characteristic of the potential of the object due to the ionized air generated by the discharge electrode is known, the time when the potential of the object reaches a predetermined value may also be determined based on the time taken from the start of the neutralization.

According to a second aspect of the present invention, there is provided a static electricity removing method of generating an electric field between an auxiliary electrode, which is provided with openings for the ionized air to pass through and disposed between the discharge electrode and the object, and the object by applying a potential having a polarity opposite to that of the object to the auxiliary electrode at the start of the static electricity removal; and decreasing the electric field by making the potential of the auxiliary electrode lower than that at the start of the static electricity removal when an absolute value of the potential of the object is equal to or less than a predetermined value.

According to the present invention, in a DC corona discharge type static electricity removing apparatus and static electricity removing method, it is possible to reduce the discharge time.

BRIEF DESCRIPTION OF THE DRAWINGS

Specific embodiments of the present invention will now be described, by way of example only, with reference to the accompanying drawings in which.

DETAILED DESCRIPTION OF THE PREFERRED EMBODIMENTS

Hereinafter, exemplary embodiments of the present invention will be described with reference to the drawings.

Figure 1:
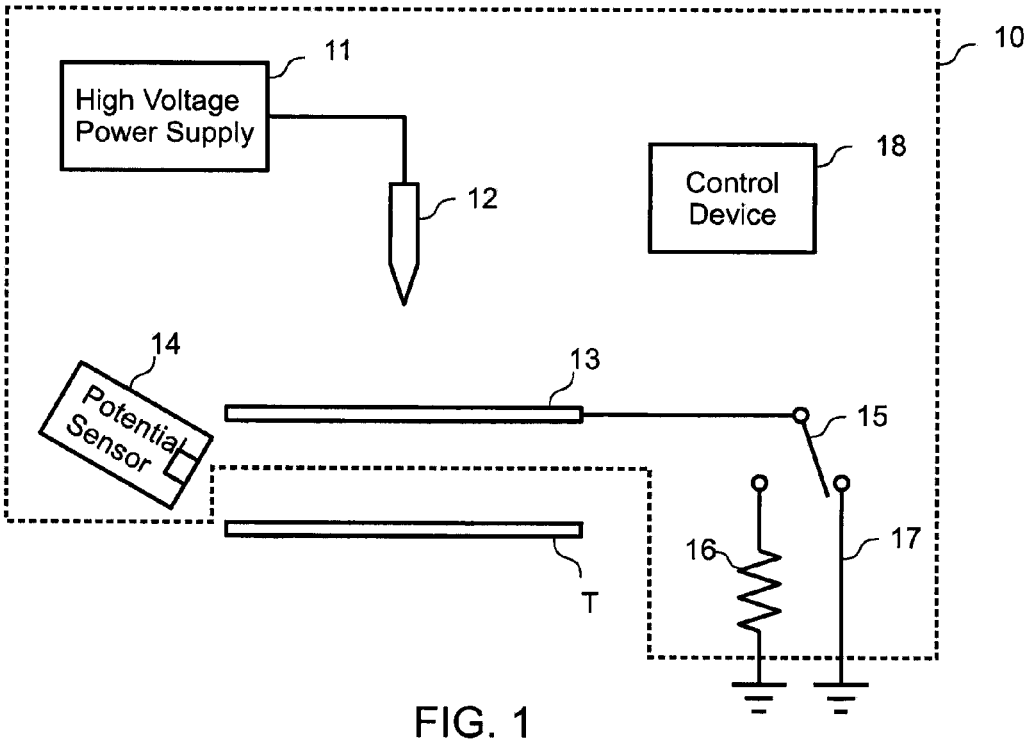
FIG. 1 is a diagram for explaining an example of a configuration of a static electricity removing apparatus according to an exemplary embodiment of the present invention.

FIG. 1 is a diagram for explaining an example of a configuration of a static electricity removing apparatus 10 according to an exemplary embodiment of the present invention. The static electricity removing apparatus 10 is a DC corona discharge type static electricity removing apparatus which generates ionized air having a polarity opposite to that of an object T charged with static electricity and which neutralizes, removes static electricity of, or discharges the object T by transporting the ionized air to the object T. The static electricity removing apparatus 10 is configured to comprise a high voltage power supply 11, a discharge electrode 12, an auxiliary electrode 13, a potential sensor 14, a switch 15, a resistor 16, a ground line 17, and a control device 18.

For corona discharge, a ground electrode disposed to face the discharge electrode 12 is required. The auxiliary electrode 13 may be also used as the ground electrode. Otherwise, a ground electrode may be disposed separately from the auxiliary electrode 13. For example, the ground electrode may be disposed so as to surround a line from the discharge electrode 12 to the auxiliary electrode 13. In addition, both of the auxiliary electrode 13 and the electrode disposed separately from the auxiliary electrode 13 may be operated as the ground electrode for the corona discharge.

In addition, those components constituting the static electricity removing apparatus 10 are appropriately disposed at predetermined positions according to a situation where the static electricity removing apparatus 10 is used.

The high voltage power supply 11 supplies a DC voltage having a polarity opposite to that of the potential of the object T to the discharge electrode 12. The discharge electrode 12 performs a corona discharge with respect to the ground electrode to generate ionized air having a polarity opposite to that of the object T. Since the generated ionized air has the same polarity as that of the discharge electrode 12, the ionized air is repulsed by the discharge electrode 12 toward the auxiliary electrode 13. Some portion of the ionized air which reaches around the auxiliary electrode 13 passes through openings of the auxiliary electrode 13 to be moved to the opposite side, and the remaining portion thereof is caught by the auxiliary electrode 13 to be flowed as a current. As described later, a potential occurs in the auxiliary electrode 13 due to the current, the ionized air is accelerated by the force of the electric field formed between the potential of the auxiliary electrode 13 and the potential of the object T, so that the ionized air reaches the object T.

The auxiliary electrode 13 is provided with openings for the ionized air generated by the discharge electrode 12 to pass through, and the auxiliary electrode 13 is disposed between the discharge electrode 12 and the object T to face the object T.

The potential sensor 14 measures the potential and polarity of the object T. The switch 15 allows the auxiliary electrode 13 to be grounded through the resistor 16 or the ground line 17 according to the control of the control device 18. The control device 18 controls starting or stopping of the discharge from the discharge electrode 12 or the space electric field control process described later.

The potential sensor 14, the switch 15, the resistor 16, the ground line 17, and the control device 18 constitute an electric field forming unit for forming an electric field in a space between the auxiliary electrode 13 and the object T. At the start of the neutralization, the auxiliary electrode 13 is grounded through the resistor 16, and thus, a potential having a polarity opposite to that of the object T is generated in the auxiliary electrode 13, so that an electric field is generated between the auxiliary electrode 13 and the object T. In addition, when the absolute value of the potential of the object T measured by the potential sensor 14 reaches under a predetermined value, the auxiliary electrode 13 is grounded through the ground line 17 to make the potential of the auxiliary electrode lower than that at the start of the static electricity removal, so that the electric field between the auxiliary electrode 13 and the object T is decreased.

Figure 2A:
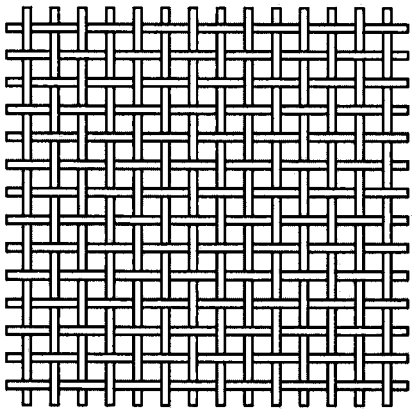
FIG. 2A to FIG. 2C show examples of auxiliary electrode configurations.
Figure 2B:
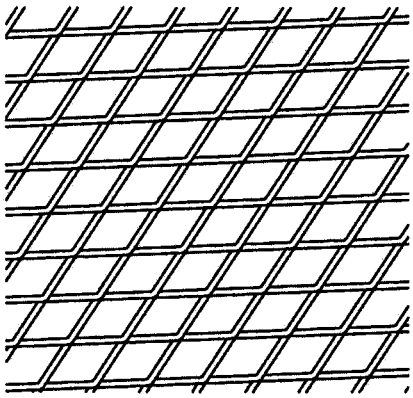
Figure 2C:
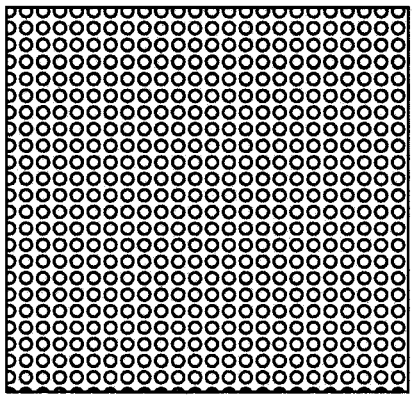

FIG. 2A to FIG. 2C show configuration examples of the auxiliary electrode 13. The auxiliary electrode 13 may be an electrode of which at least a portion is formed in a net shape. FIG. 2A shows a wire net in which wire conductors are woven together, FIG. 2B shows an expanded metal in which a metal plate is mechanically processed into a mesh formed by diamond-shaped voids surrounded by interlinked bars, and FIG. 2C shows a punching metal in which a conductor plate is processed by puncturing holes. Although the electrode shown in each of the drawings is formed wholly in a net shape, the shown is a net shaped part of the auxiliary electrode 13 and it does not mean that the whole of the auxiliary electrode 13 is formed in a net shape. Although metal is generally used as an electrode material, a conductive resin or the like may also be used as an electrode material. The electrode formed in such a net shape may be used as the auxiliary electrode 13 so that the auxiliary electrode 13 can allow the ionized air to pass through and generate the electric field between the electrode and the object T.

Here, the evaluation of performance of the static electricity removing apparatus will be described before the description of the operations of the static electricity removing apparatus 10 shown in FIG. 1.

In general, the neutralization performance of the static electricity removing apparatus is determined by a "discharge time" and an "offset voltage." The discharge time is expressed by the attenuation time taken when the charged voltage of the object is discharged from +1000 V to +100 V or from −1000 V to −100 V. The offset voltage is expressed by the final voltage when the ions are balanced and the object potential becomes constant. As the discharge time is shortened and as the offset voltage is closer to 0 V, the performance as the static electricity removing apparatus becomes good. The value of +100 V or −100 V for the definition of the discharge time is a simple standard for a general use. Therefore, in some uses, a value smaller than the value may be required for rapid neutralization.

Figure 3:
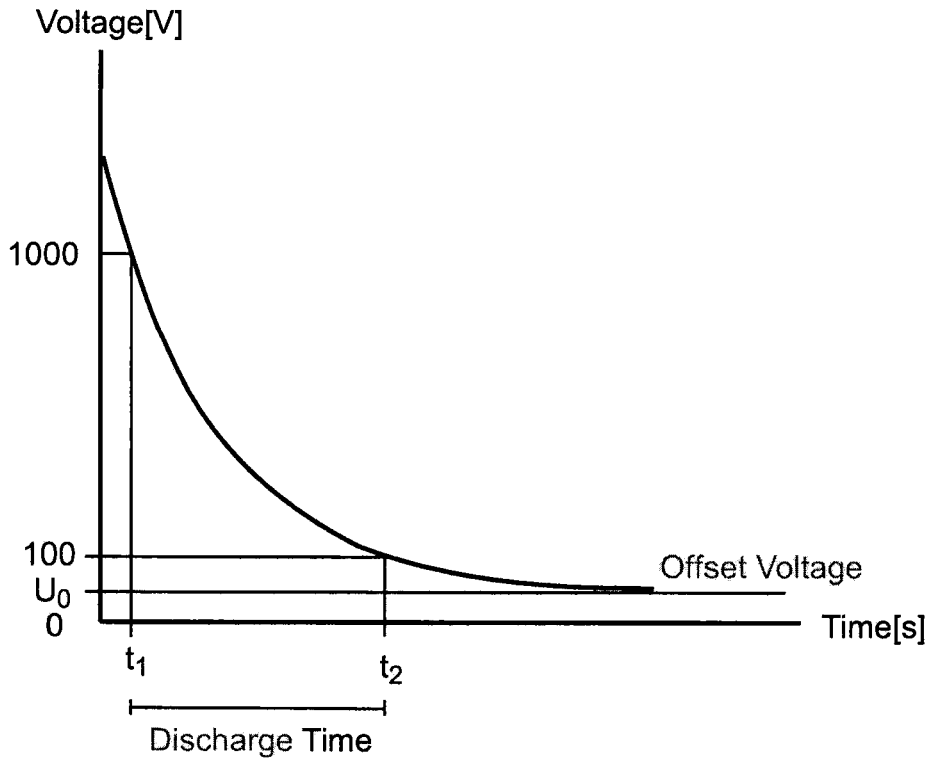
FIG. 3 is a diagram illustrating an example of neutralization performance of a static electricity removing apparatus.

FIG. 3 is a diagram illustrating an example of the neutralization performance of the static electricity removing apparatus. In this case, the discharge time is defined as $t_2-t_1$ and the offset voltage is defined as $U_0$ [V].

Figure 4:
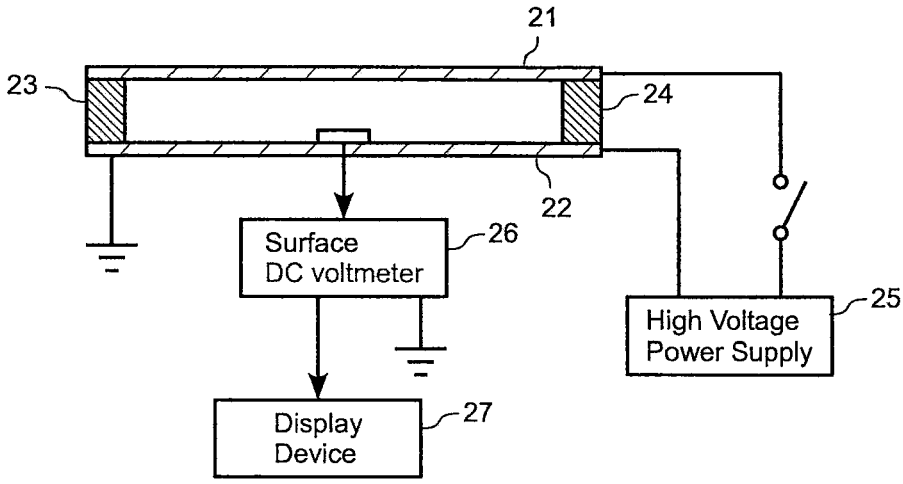
FIG. 4 is a diagram illustrating an example of a configuration of an evaluation device which measures the neutralization performance of a static electricity removing apparatus.

The measurement of the neutralization performance is performed, for example, by using an evaluation device called a Charged Plate Monitor (CPM) of which the configuration is exemplarily illustrated in FIG. 4. The evaluation device includes parallel metal plates 21 and 22, insulating members 23 and 24, a high voltage power supply 25, a surface DC voltmeter 26, and a display device 27. The metal plate 21 simulates the object T. At least the surface of the metal plate 21, which is opposite to the metal plate 22, is exposed to outside, and the other portions are enclosed in a casing (not shown). Ionized air from a static electricity removing apparatus (not shown) is configured to collide with the exposed surface of the metal plate 21. A sensor unit of the surface DC voltmeter 26 is disposed at a position where the surface potential of the metal plate 21 can be measured.

The metal plates 21 and 22 are configured to be parallel to each other by one or more of insulating members 23 and 24 in FIG. 4. The metal plates 21 and 22 have a size of 150 mm by 150 mm and a capacitance of 20 pF±2 pF. The size and capacitance are set so as to simulate an 8-inch wafer. The metal plate 21 is used in the floating state, and the metal plate 22 is grounded.

To evaluate the performance of the static electricity removing apparatus, a voltage of positive or negative 1000 V or more is applied between the metal plates 21 and 22 from the high voltage power supply 25, so that the metal plate 21 is charged. After that, the metal plate 21 is in the floating state, and the ionized air having an opposite polarity is transported from the static electricity removing apparatus to the metal plate 21, so that the static electricity of the metal plate 21 is removed and the metal plate 21 is neutralized. At this time, the potential of the metal plate 21 is measured by the surface DC voltmeter 26 in a non-contact manner. The measurement result is displayed, for example, on the display device 27 as a time sequence graph. FIG. 3 corresponds to an example of the measurement result displayed on the display device 27.

Figure 5A:
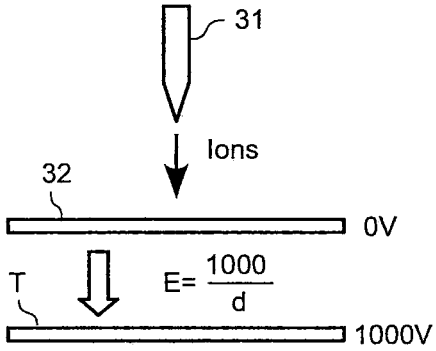
FIG. 5A and FIG. 5B are diagrams for explaining a principle for reducing the discharge time.
Figure 5B:
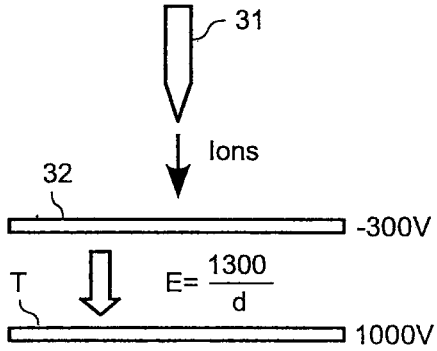

FIG. 5A and FIG. 5B are diagrams for explaining a principle of the present invention for reducing the discharge time. The discharge electrode 31 generates ionized air by corona discharge. The auxiliary electrode 32 is provided with openings for the ionized air generated by the discharge electrode 31 to pass through, and the auxiliary electrode 32 is disposed between the discharge electrode 31 and the object T and faces the object T. The ionized air passing through the openings is transported by the electric field between the auxiliary electrode 32 and the object T.

The following cases are assumed: a case where the object T is charged to 1000 V and the auxiliary electrode 32 is grounded as illustrated in FIG. 5A; and a case where the object T is charged to 1000 V and the potential of the auxiliary electrode 32 has a polarity opposite to that of the object T as −300 V as illustrated in FIG. 5B.

The transport speed v of the ions to the object T is expressed as follows, when the flow rate of an ionized air, the mobility, and the electric field are denoted by $v_o$, μ, and E, respectively.

$$v=v_o+\mu E$$

On the other hand, if it is assumed that the object T and the auxiliary electrode 32 are parallel plates with a gap d, the electric field E between the object T and the auxiliary electrode 32 and the voltage V between the object T and the auxiliary electrode 32 are expressed as follows.

$$V=Ed$$

Therefore, in the case where the object T is charged to 1000 V and the auxiliary electrode 32 is grounded, the electric field E is expressed as follows.

$$E=1000/d$$

On the other hand, in the case where the potential of the auxiliary electrode 32 is −300 V, the electric field E is expressed as follows.

$$E=1300/d$$

In other words, the auxiliary electrode 32 is configured to be disposed between the discharge electrode 31 and the object T, and the polarity of the auxiliary electrode 32 opposes to that of the object T, so that the electric field in the space between the auxiliary electrode 32 and the object T is increased. Therefore, the transport speed v of the ions to the object T can be increased. Due to the increase in the transport speed v, the ions reach the object T in a shorter time, so that the discharge time is reduced.

Figure 6:
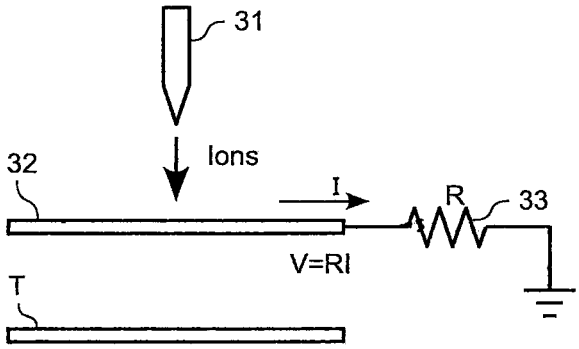
FIG. 6 is a diagram for explaining a reason why the polarity of the auxiliary electrode becomes opposite to that of the object.

FIG. 6 is a diagram for explaining a reason for setting the potential of the auxiliary electrode 32 to have a value having a polarity opposite to that of the object T.

FIG. 6 is a diagram for explaining a reason why the polarity of the auxiliary electrode 32 becomes opposite to that of the object T. In this example, the auxiliary electrode 32 is grounded through a resistor 33. A part of ions from the discharge electrode 31 flows into the auxiliary electrode 32, and flows through the resistor 33 to the ground potential. The current of this is expressed by "I." The voltage induced on the auxiliary electrode 32 is expressed as follows;

$$V=RI$$

In other words, the polarity of the auxiliary electrode 32 can be made oppose to that of the object T (made be same with that of the discharge electrode) by generating ions having a polarity opposite to that of the object T from the discharge electrode 31 and grounding the auxiliary electrode 32 through the resistor 33.

Since the generated ionized air has a polarity same with that of the discharge electrode 31, it is repulsed by the discharge electrode 31. The ionized air also repulses itself. Since the force of repulsion is large enough, the ionized air can flow toward the auxiliary electrode 32 even if the polarity of the auxiliary electrode 32 is same as that of the ionized air as described above. The ionized air, not trapped by the auxiliary electrode 32 and passing through the openings of the auxiliary electrode 32, is urged by the electric field between the auxiliary electrode 32 and the object T to reach the object T The potential of the auxiliary electrode 32 may also be set by connecting the auxiliary electrode 32 to a power source. However, since it requires another power source, the costs is increased. By allowing the auxiliary electrode 32 to be grounded through the resistor 33, it is possible to generate the electric field between the auxiliary electrode 32 and the object T at a low cost.

Figure 7:
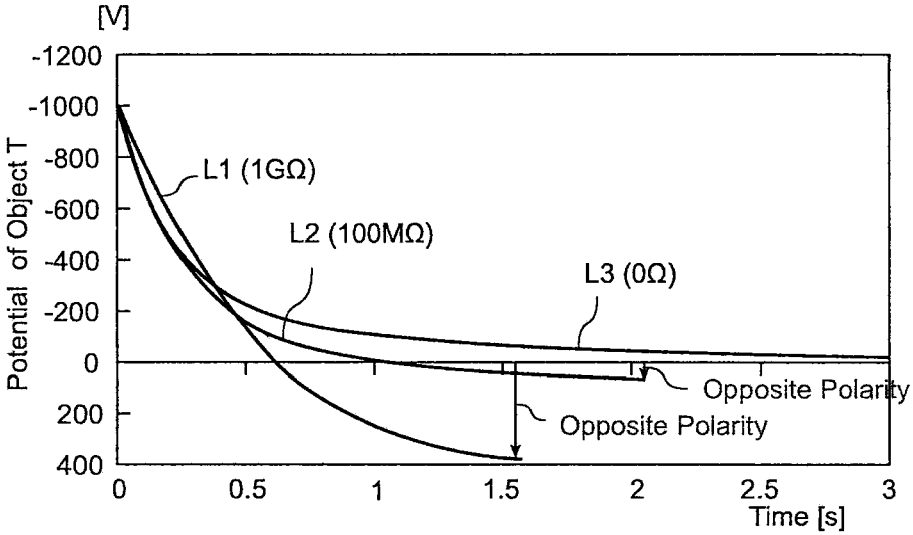
FIG. 7 is a diagram illustrating a measurement result of neutralization performance according to a value of a resistor.

FIG. 7 is a diagram illustrating the measurement result of the neutralization performance of the case where the value of the resistor 33 is 1 GΩ or 100 MΩ and the case where the auxiliary electrode is grounded without the resistor 33. The line L1 illustrates the neutralization performance of the case where the resistance value of the resistor 33 is 1 GΩ; the line L2 illustrates the neutralization performance of the case where the resistance value of the resistor 33 is 100 MΩ; and the line L3 illustrates the neutralization performance of the case where the auxiliary electrode is grounded without the resistor 33 (that is, the case where the resistance value between the auxiliary electrode 32 and the ground potential is about 0Ω).

The measurement is performed by the evaluation device illustrated in FIG. 4. In the case where the auxiliary electrode 32 is grounded through the resistor 33, the metal plate 21 of the evaluation device illustrated in FIG. 4 is set to the position corresponding to the object T illustrated in the example of FIG. 6, and the metal plate 21 is charged with a negative voltage of −1000 V or more, so that positive ionized air is generated by the discharge electrode 31. The generated ionized air is transported by the electric field between the auxiliary electrode 32 and the metal plate 21. In the case where the auxiliary electrode is directly grounded without the resistor 33 (in the case of 0Ω), although the same measurement is basically performed as that of the case where the auxiliary electrode is grounded through the resistor 33, the auxiliary electrode 32 is directly grounded through a ground line (not shown). The vertical axis denotes the potential of the metal plate 21, and the horizontal axis denotes the time in FIG. 7.

The measurement result illustrated in FIG. 7 shows that, in comparison with the discharge time of the case where the auxiliary electrode 32 is directly grounded (that is, the case where the resistance value between the auxiliary electrode 32 and the ground potential is about 0Ω), the discharge time of the case where the auxiliary electrode 32 is grounded through the resistor 33 having 100 MΩ or 1 GΩ (lines L1 and L2) is short.

In addition, in comparison with the case where the resistance value of the resistor 33 is set to 100 MΩ, the tendency of neutralization just after the start of the neutralization becomes slower in the case where the resistance value of the resistor 33 is set to 1 GΩ. It is understood that it is because the amount of ions generated in the discharge electrode 31 is decreased due to the increased voltage of the auxiliary electrode 32.

On the other hand, according to the measurement result illustrated in FIG. 7, in comparison with the case where the auxiliary electrode 32 is directly grounded without the resistor 33, the offset voltage of the object T is in the opposite polarity in the case where the auxiliary electrode 32 is grounded through the resistor 33. This is because, after the potential of the object T almost reaches 0 V, a potential occurs in the auxiliary electrode 32 due to the current I, the ions are transported to the object T through the electric field due to the potential difference. Therefore, although the discharge time defined by the discharge time is reduced, after that, the object T is charged with an opposite polarity, so that the time up to the completion of neutralization may not be reduced.

In order to solve the problem, the static electricity removing apparatus 10 illustrated in FIG. 1 performs a process (referred to as a "space electric field control process") where, during the time when the potential of the object T is high, the potential of the auxiliary electrode 13 is kept high so as to increase the amount of transported ions, so that the discharge time is reduced, and after the absolute value of the potential of the object T is reduced to a certain value or less, the potential of the auxiliary electrode 13 is allowed to decrease so as to suppress the amount of transported ions, so that the offset is reduced.

Figure 8:
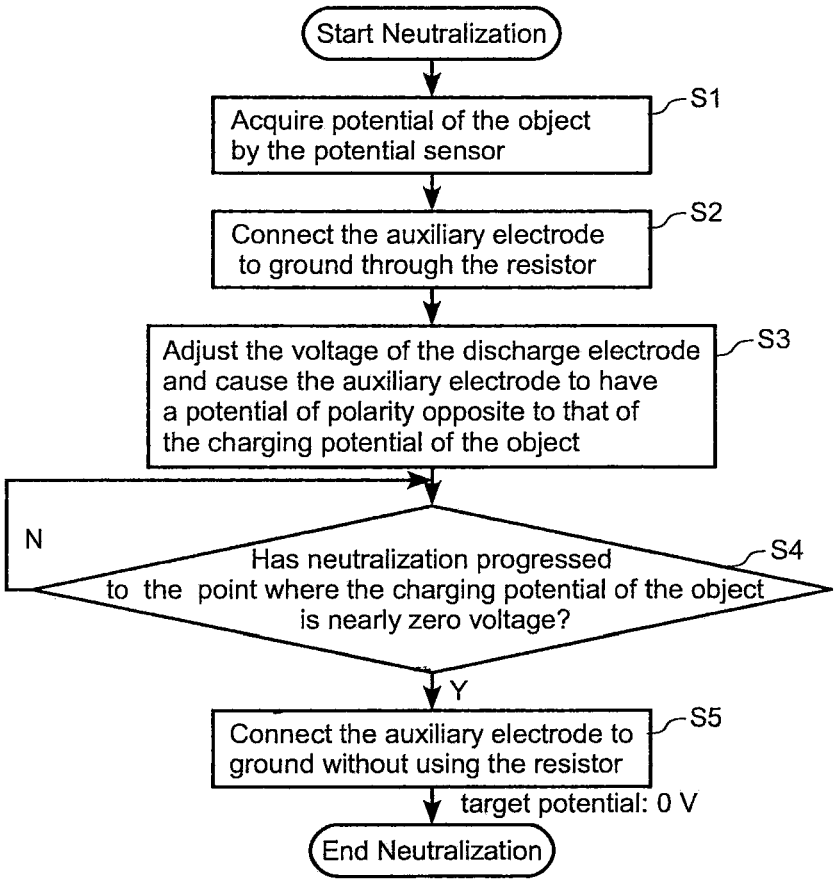
FIG. 8 is a flowchart for explaining a space electric field control process.

FIG. 8 is a flowchart for explaining the space electric field control process of the static electricity removing apparatus 10.

If the static electricity removing apparatus 10 is powered on, in Step S1, the control device 18 activates the potential sensor 14 to start the measurement of the potential of the object T and acquires the measurement result (potential of the object T). Herein, it is assumed that the potential of the object T is 1000V or more (positive value).

Next, in Step S2, the control device 18 connects the switch 15 to the side of the resistor 16 (in the case where the switch 15 is connected to the side of the resistor 16 in the initial state, the state is maintained), and the auxiliary electrode 13 is grounded through the resistor 16 (the resistor is connected between the auxiliary electrode 13 and the ground potential).

Next, in Step S3, the control device 18 starts up the high voltage power supply 11 and adjusts the output voltage and the polarity thereof. Therefore, the high voltage power supply 11 supplies a DC voltage, having a polarity opposite to the potential of the object T, to the discharge electrode 12 for the corona discharge. The discharge electrode 12 performs the corona discharge to generate ionized air having a polarity (in this example, negative) opposite to that of the object T.

Similarly to the description with reference to FIG. 6, the potential having a polarity opposite to that of the object T, which is expressed by a product of the value of the current flowing from the auxiliary electrode 13 through the resistor 16 (in FIG. 6, the resistor 33) to the ground potential and the resistance value of the resistor 16, occurs in the auxiliary electrode 13 (in FIG. 6, the auxiliary electrode 32). For example, it is assumed that about 90% to 98% of the ion current has been caught by the auxiliary electrode 13 and has flowed through the resistor 16 to the ground potential, and 2% to 10% of the ion current has passed through the openings of the auxiliary electrode 13, moved to the opposite side thereof and flowed to the object T. In addition, it is assumed that the current due to the negative ions from the discharge electrode 12 is −1 mA. In this case, if the resistance value of the resistor 16 is 100 MΩ, a voltage of −90 to −98 V occurs in the auxiliary electrode 13.

In this manner, when a predetermined potential having a polarity opposite to that of the object T occurs in the auxiliary electrode 13, the generated ionized air is transported toward the object T by the force of the electric field in the space between the auxiliary electrode 13 and the object T, so that neutralization starts.

In this manner, when neutralization starts, in Step S4, the control device 18 determines whether or not the static electricity charged in the object T has been removed. Till the time it is determined that the static electricity has been removed, the determination process is repeated. The determination process is performed, for example, by determining whether or not the charge potential of the object T becomes 0 V or a predetermined voltage in the vicinity of 0 V based on the measurement result of the potential sensor 14.

When it is determined that the static electricity of the object T was removed, in Step S5, the control device 18 connects the switch 15 to the ground line 17 side, so that the auxiliary electrode 13 is directly grounded without the resistor 16.

After that, the process is finished. As described hereinbefore, the space electric field control process is performed.

Figure 9:
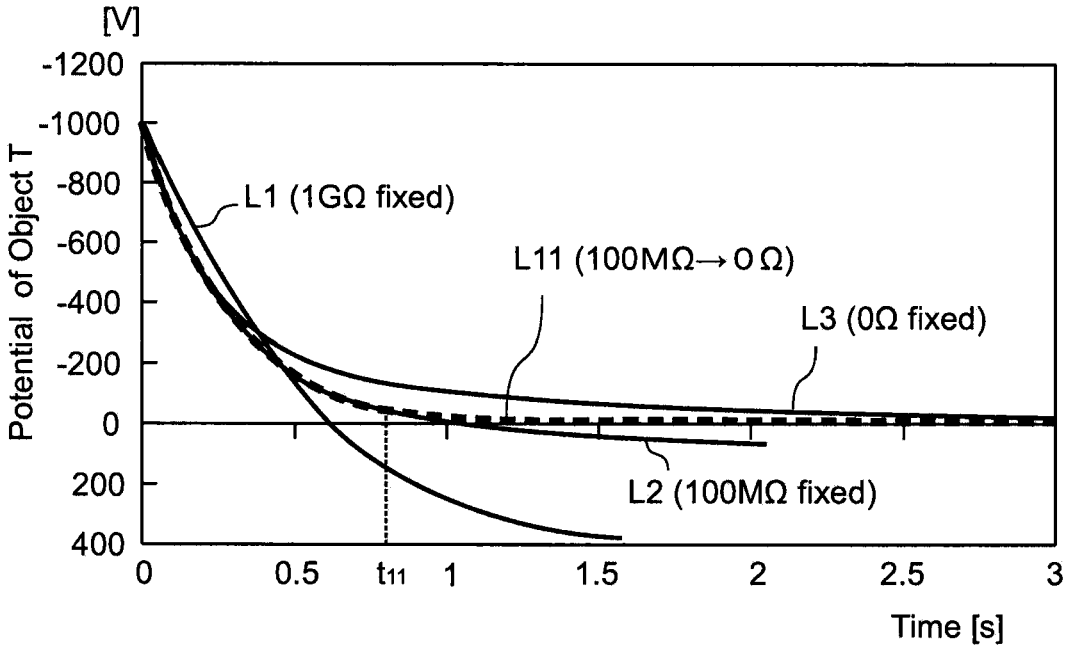
FIG. 9 is a diagram for explaining a neutralization performance according to space electric field control.

FIG. 9 is a diagram for explaining the neutralization performance according to the space electric field control. The lines L1, L2 and L3 illustrated by solid lines are the same as those illustrated in FIG. 7. The line L11 illustrated by a broken line illustrates the neutralization performance in the case where the neutralization is performed by the space electric field control process. In this example, at the time $t_{11}$, the switch 15 is switched over from the resistor 16 to the side of ground line 17.

In other words, at the start of the neutralization, a potential having a polarity opposite to that of the object T occurs in the auxiliary electrode 13 (Steps S2 and S3), so that a high electric field is generated between the auxiliary electrode 13 and the object T. Accordingly, the ions reach the object T at a higher transport speed, so that it is possible to reduce the discharge time.

In addition, when neutralization is performed so that the potential of the object T becomes a predetermined value, for example, near 0 V (at the time $t_{11}$ in the example of FIG. 9), the switch 15 is connected to the side of ground line 17, so that the auxiliary electrode 13 is directly grounded without the resistor 16 (Step S5), and the potential of the auxiliary electrode 13 becomes 0 V (zero volts). Accordingly, the electric field between the auxiliary electrode 13 and the object T is reduced, and the amount of ions transported to the object T is suppressed, so that the ion balance can be stabilized in the vicinity of 0 V.

In known art in this field, compressed air or a fan is used for spraying ionized air generated by corona discharge onto the object T. On the other hand, in the above-mentioned embodiment, a flow of ions is generated and neutralizes the object T without compressed air or a fan, by means of the auxiliary electrode 13 being disposed to be grounded through the resistor 16 and the electric field being generated in the space between the auxiliary electrode 13.

Figure 10:
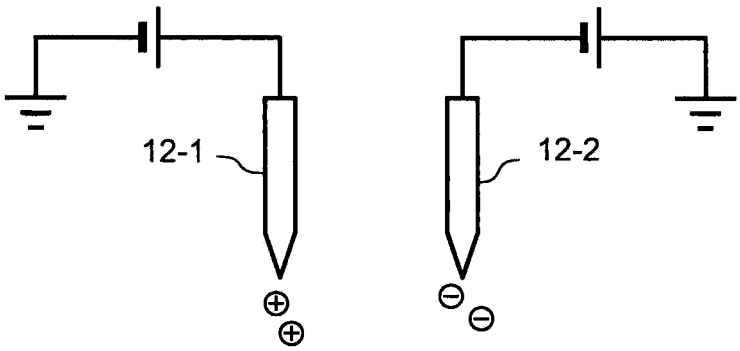
FIG. 10 is a diagram for explaining a modified example of the discharge electrode.

FIG. 10 is a diagram for explaining a modified example of the discharge electrode. Although the cases where one discharge electrode (discharge electrode 12 or 31) is used are described in the embodiments described above, as illustrated in FIG. 10, two discharge electrodes 12-1 and 12-2 having different polarities may also be used.

In other words, the discharge electrode 12-1 is configured as an electrode for generating only positive ions, and the discharge electrode 12-2 is configured as an electrode for generating only negative ions. The application of voltage to the discharge electrodes 12-1 and 12-2 may be performed by separate high voltage power supplies. Alternatively, the application of voltage may be performed by switching the connection to a common high voltage power supply. In addition, voltages having opposite polarities may also be simultaneously applied to the discharge electrodes 12-1 and 12-2. By adjusting the voltages simultaneously applied to the discharge electrodes 12-1 and 12-2, the balance of the ions generated may also be adjusted.

In the description hereinbefore, the auxiliary electrode 13 disposed between the discharge electrode 12 and the object T is grounded through the resistor 16 or directly grounded through the ground line 17 by the switch 15. This configuration may be arranged any way as long as the resistance value between the auxiliary electrode 13 and the ground potential may be variably set. For example, a variable resistor may be used instead of the switch 15, the resistor 16. In addition, it may use a configuration in which the auxiliary electrode 13 is always connected to the resistor 16, and the switch 15 is used as a by-pass with respect to the resistor 16 to connect the auxiliary electrode 13 and the ground line 17. If the resistance value is smaller than the resistance value of the resistor 16, a resistor may also exist between the auxiliary electrode 13 and the switch 15 or between the auxiliary electrode 13 and the ground line 17.

A DC power supply used as the high voltage power supply 11 may be replaced by an AC power supply. In such a case, the voltage of the discharge electrode 12 is adjusted to be shifted to a voltage having a polarity opposite to that of the charge potential of the object T, so that positive or negative ions may be generated.

In the description hereinbefore, the change in the potential of the auxiliary electrode 13 is performed based on the measurement result of the potential sensor 14. In the case that the time-changing characteristic of the potential of the object T due to the ionized air generated by the discharge electrode 12 is known, the determination may also be performed based on the time taken from the start of the neutralization.

What is claimed is:

1. A static electricity removing apparatus for removing static electricity of a charged object, comprising:

a discharge electrode which generates an ionized air having a polarity opposite to that of the object;

an auxiliary electrode which is provided with openings for the ionized air to pass through and disposed between the discharge electrode and the object for the ionized air to be accelerated by a force of an electric field formed between a potential of the auxiliary electrode and a potential of the object; and an electric field control means which generates the electric field by applying the potential having a polarity opposite to that of the object to the auxiliary electrode at the start of the static electricity removal, and decreases the electric field by making the potential of the auxiliary electrode lower than that at the start of the static electricity removal when an absolute value of the potential of the object is equal to or less than a predetermined value.

2. The static electricity removing apparatus according to claim 1, in which the electric field control means includes a resistance value changing means which changes a resistance value between the auxiliary electrode and the ground potential to change the potential of the auxiliary electrode.

3. The static electricity removing apparatus according to claim 2, in which the resistance value changing means includes:

a resistor; and a switch which connects the auxiliary electrode to a ground electrode through the resistor at the start of the static electricity removal and connects the auxiliary electrode to a ground potential without the resistor at the end of the static electricity removal.

4. The static electricity removing apparatus according to claim 1, in which the auxiliary electrode is an electrode of which at least a portion is formed in a net shape.

5. The static electricity removing apparatus according to claim 1, comprising a potential sensor which measures the potential of the object, in which the time when the potential of the object becomes the predetermined value is detected by the potential sensor.

6. A static electricity removing method of generating ionized air having a polarity opposite to that of a charged object by means of a discharge electrode and removing static electricity of the object by using the generated ionized air, comprising:

generating an electric field between an auxiliary electrode, which is provided with openings for the ionized air to pass through and disposed between the discharge electrode and the object, and the object by applying a potential having a polarity opposite to that of the object to the auxiliary electrode at the start of the static electricity removal for the ionized air to be accelerated by a force of the electric field formed between the potential of the auxiliary electrode and a potential of the object; and decreasing the electric field by making the potential of the auxiliary electrode lower than that at the start of the static electricity removal when an absolute value of the potential of the object is equal to or less than a predetermined value.

* * * * *